US006236933B1

(12) United States Patent
Lang

(10) Patent No.: US 6,236,933 B1
(45) Date of Patent: May 22, 2001

(54) INSTANTANEOUS TRAFFIC MONITORING SYSTEM

(75) Inventor: Brook Lang, Kirkland, WA (US)

(73) Assignee: Infomove.COM, Inc., Kirkland, WA (US)

( * ) Notice: Subject to any disclaimer, the term of this patent is extended or adjusted under 35 U.S.C. 154(b) by 0 days.

(21) Appl. No.: 09/447,283

(22) Filed: Nov. 23, 1999

Related U.S. Application Data

(60) Provisional application No. 60/109,917, filed on Nov. 23, 1998.

(51) Int. Cl.[7] ..... G08G 1/09

(52) U.S. Cl. ..... 701/117; 701/118; 701/119; 701/121; 340/905; 340/910; 340/988; 340/990

(58) Field of Search ..... 701/117, 118, 701/119, 211, 121, 23, 24, 25, 26; 342/357.13, 450, 454; 340/905, 907, 910, 988, 993, 994, 990; 379/58, 59; 455/33.1; 370/312

(56) References Cited

U.S. PATENT DOCUMENTS 4,361,202 * 11/1982 Minovitch ..... 180/168
4,985,705 * 1/1991 Stammler ..... 342/69
5,131,020 * 7/1992 Liebesny et al. ..... 379/59
5,428,545 * 6/1995 Maegawa et al. ..... 364/444
5,465,289 * 11/1995 Kennedy, Jr. ..... 379/59
5,539,645 * 7/1996 Mandhyan et al. ..... 701/117
5,745,865 * 4/1998 Rostoker et al. ..... 701/117

* cited by examiner

*Primary Examiner*—William A. Cuchlinski, Jr.
*Assistant Examiner*—Yonel Beaulieu
(74) *Attorney, Agent, or Firm*—Dean A. Craine

(57) ABSTRACT

A system for instantaneously monitoring traffic congestion including a plurality of monitoring electronic devices located in motor vehicles traveling on roadways in a selected region. Each monitoring electronic device is coupled to a GPS receiver that provides physical location to a wireless modem capable of connecting to a wireless communication network. The system also includes a central computer connected to a wide area network that is able of continuously downloading physical location information from a plurality of monitoring electronic devices also connected to the wide area network. The central computer uses a traffic monitoring software program and a mapping database containing roadway information for a region and the movement information from the monitoring electronic devices to create a continuously updated traffic congestion database. Authorized users of the system are able to log onto the central computer to a portion of the database that contains specific traffic flow and congestion information. Using the system, users are also able to obtain estimated times of arrival for a specific trip, and recommendations on alternative route information. The system can also take into consideration current or anticipated events that may affect traffic congestion.

29 Claims, 5 Drawing Sheets

INSTANTANEOUS TRAFFIC MONITORING SYSTEM

This utility patent application is based on a provisional patent application (Ser. No. 60/109,917), filed Nov. 23, 1998.

BACKGROUND OF THE INVENTION

1. Field of the Invention

This invention relates to traffic monitoring systems, and more particularly, to such systems that provide instantaneous, continuous, and specific information on traffic congestion.

2. Description of the Related Art

Many municipalities use video cameras perched on top of tall poles located at different locations along roadways to monitor traffic congestion. The video cameras are operated by individuals in a central viewing office who watch a bank of monitors showing images of the traffic from the video cameras. By watching these images, trained individuals are able to analyze the traffic congestion and provide some quantitative measurement, (i.e. stopped, slow, below or at speed limit; and light, moderate, heavy, grid-locked, respectively). Local television and radio stations are able to broadcast this information to drivers who turn on their televisions and radios for the latest traffic update. This method of monitoring and reporting traffic congestion is commonly referred to as the view-and-relay method.

One problem with the view-and-relay method is that information is not instantaneously updated and immediately available to drivers. With dozens of video cameras located around a region, it often takes several minutes before an accident or a slow down on a roadway is recognized and reported to the public. When a report is finally given, the precise location or cause of the traffic congestion and the lanes of traffic affected can be difficult to determine. The quantitative terms used to describe the resulting traffic congestion may be too vague to be useful.

Another problem with the view-and-relay method is that it does not provide estimated travel time between points on a route. Knowing such information, estimated times of arrival (ETA) from a starting location to a desired destination following a preferred route or following alternative routes could be provided taking into consideration current or future traffic conditions along on roadways used in the routes.

Another problem with the view-and-relay method is that it does not provide comparative roadway traffic congestion information that would allow drivers to choose alternative, less congested roadways. In a large metropolitan area, alternative roadways are usually available for reaching a desired destination. Knowing the current and anticipated traffic conditions on the preferred roadway and on alternate roadways would allow drivers to adjust their plans regarding which routes to reduce their travel time and to more evenly distributed traffic flow over all the roadways in the region.

Another problem with the view-and-relay method is that it does not provide information on the flow of traffic in the individual lanes. It is well known that the flow of traffic in individual lanes in a multiple lane roadway can vary greatly. While accidents and merging traffic is often the cause of the variation, in some instances drivers with different driving styles cause the variations. Knowing which lane is flowing faster would be desirable for many drivers.

A further problem with the view-and-relay method is that it does not provide predictive or anticipated traffic congestion information. For example, how is traffic congestion on a freeway impacted when a lane closes for construction at 10:00 P.M.? Or, is traffic congestion on different roadways in the region impacted when a large sporting event ends? To answer these questions, both current and anticipated traffic congestion information on selected roadways must be known. Unfortunately, the view-and-relay method does not provide this information.

SUMMARY OF THE INVENTION

It is an object of the present invention to provide an improved system of monitoring and reporting traffic congestion.

It is an object of the present invention to provide such a system that provides more accurate and more updated traffic information.

It is an object of the present invention to provide such a system that can be used to provide alternate routes to drivers.

It is another object of the present invention to provide such a system that can be used to provide estimated times of arrival for a route using either the preferred roadway, or the alternate roadways.

It is a further object of the present invention to provide such a system that can provide comparative roadway and route information to drivers, thereby enabling them to choose less congested roadways and faster routes.

It is a still further object of the invention to provide predictive or anticipated traffic congestion information.

These and other objects are met by the improved traffic monitoring system disclosed herein that uses a plurality of monitoring electronic devices located in different motor vehicles travelling on various roadways throughout a selected region. Each monitoring electronic device, which may be a hand-held device, a laptop computer, a PDA (Personal Digital Assistant), or an on-board computer, is coupled to a means capable of instantaneously establishing the physical location, the heading and the velocity (collectively referred to as movement information) of the monitoring electronic device at any time while driving. Each monitoring electronic device is also coupled to a wireless communication means that enables the monitoring electronic device to connect to a wide area computer network, such as the INTERNET anywhere throughout the region. A central computer is provided that connects to the wide area network, which is designed to receive the movement information from a plurality of monitoring electronic devices.

During operation, the movement information is continuously transmitted to and processed by the central computer to create a large traffic congestion database for the region. The traffic congestion database is constantly updated and used along with other databases to provide traffic and other traffic-related information for users on roadways in the region. More specifically, the information in the databases can be used to inform users of current or anticipated traffic conditions on roadways along their current routes, and on roadways on alternative routes. In addition, the information from the databases can be used to inform users of the traffic flow on specific traffic lanes on a multiple lane roadway, such as the HOV lanes.

In addition to providing current traffic congestion information, the system can also be used to provide estimated times of arrival (ETAs) for current or alternative routes based on current anticipated predicted traffic conditions. During use, users submit a request for ETA information to the central computer for a specific route. The request is submitted along with a start time, destination information, and route information. The central computer then processes the request and the accompanying information using a plurality of router engines and databases to provide an ETA for the selected route. Along with providing ETAs for a selected route, the system can also be used to provide ETAs for alternative routes and/or anticipated future routes. In order to provide an ETA, the central computer may use an optional roadway specific database that contains specific information about the various roadways along the route, the total distance to be traveled along the route; the number of stop lights along each roadway; and the anticipated velocity of the user's motor vehicle based on the posted speed limit, historical information relative to that route, and the anticipated velocity of the user's motor vehicle based on the posted speed limit, and/or the calculated average velocity of other monitoring electronic devices traveling ahead of the user on the roadways. In addition, the central computer may also use an optional roadway event database that contains information on past, present and future events that may affect traffic on the roadways along the route, such as construction, sporting events, a parade, etc. By using all of the above databases, the central computer is able to provide relatively accurate ETAs twenty-four four hours per day, seven days a week.

When ETAs calculations are made for both a current route and alternative routes, the central computer is able to recommend that less congested roadways be taken. In addition, once a user has chosen a route and has made his or her choice known to the system, the central computer can monitor his or her progress and the traffic conditions on roadways ahead of the user, and recommend alternative roadways, or specific lanes of traffic that are moving faster.

The system is adaptable for receiving manually inputted traffic data from users, or other sources, such as companies, and state and local municipalities. This manually inputted data is also used in the prediction of ETA and relayed as traffic information to the users.

DESCRIPTION OF THE PREFERRED EMBODIMENT(S)

Figure 1:
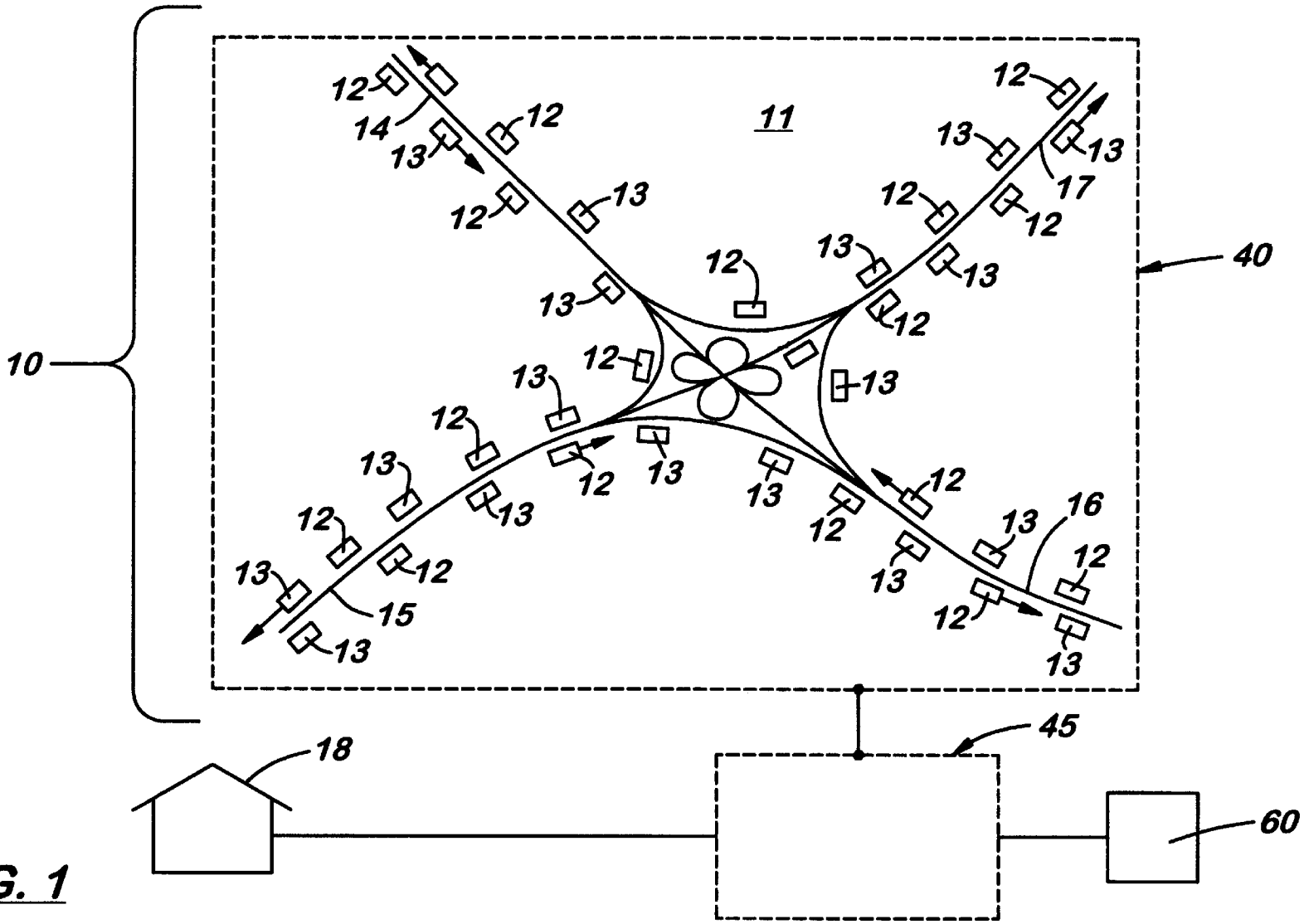
FIG. 1 is an illustration showing the traffic monitoring system disclosed herein being used by a plurality of motor vehicle drivers traveling along roadways in a region.

In FIG. 1, an instantaneous and continuous traffic monitoring system 10 is shown, designed to inform different users of current or predicted traffic congestion information on specific roadways 14–17 in a region. The system 10 includes a plurality of monitoring motor vehicles 12, each capable of communicating to a central computer 60 connected to a wide area network 15 their current movement information 27 along a roadway. The authorized users located in monitoring motor vehicles 12, in non-monitoring motor vehicles 13, and in fixed locations 18, are all able to request and receive current traffic congestion information, current and future ETA information, and comparative alternative route information and recommendations using their electronic devices 20.

Figure 2:
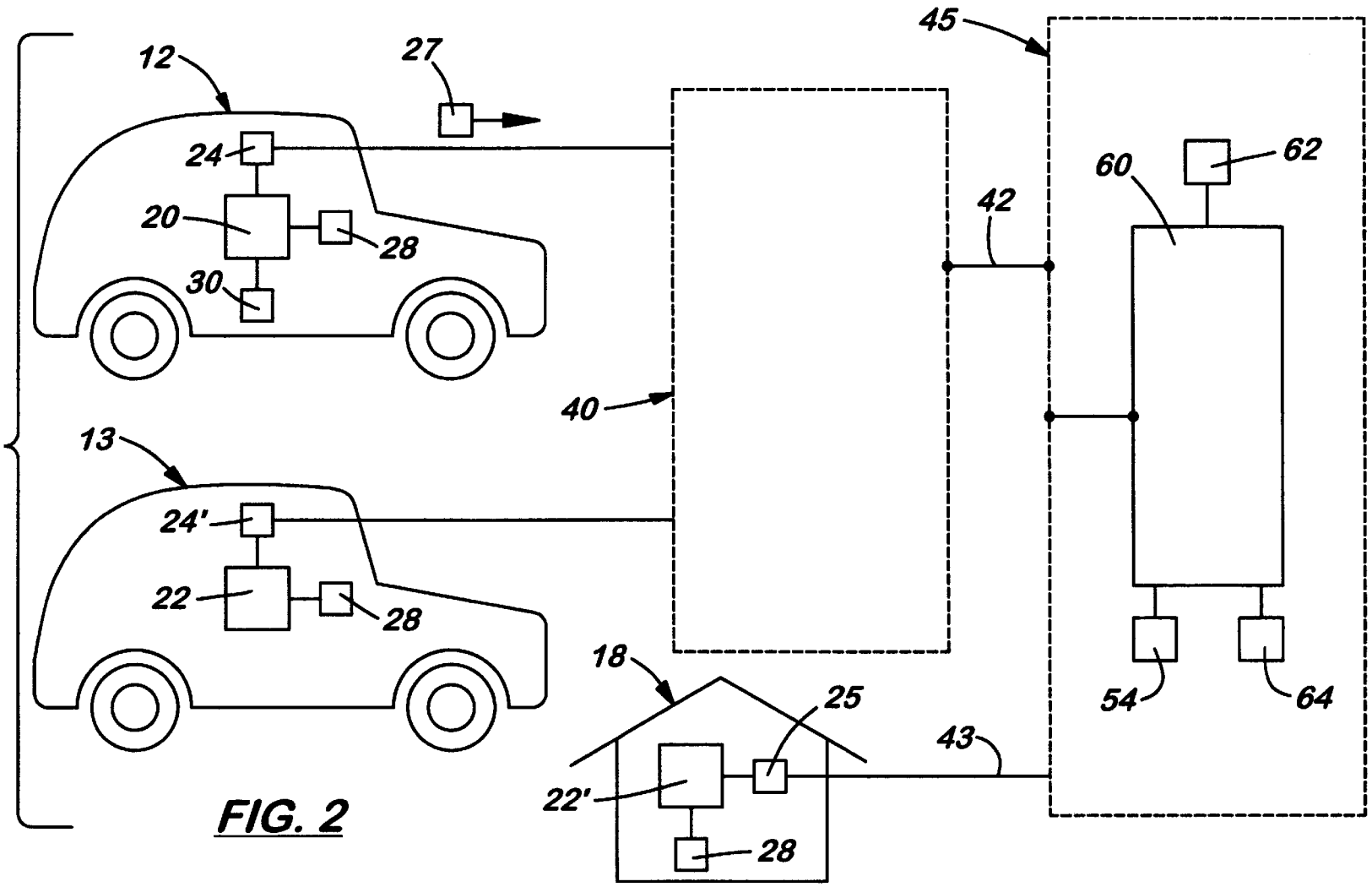
FIG. 2 is a schematic of the traffic monitoring system disclosed herein.

As shown in FIG. 2, each monitoring motor vehicle 12 has a monitoring electronic device 20 capable of transmitting its current movement information, denoted by reference number 27. The monitoring electronic device 20 may be a hand-held device, a lap-top computer, a PDA, or an on-board computer coupled to a physical location detection means capable of instantaneously determining the physical location, heading, and elevation of the monitoring electronic device 20, and hence, the monitoring motor vehicle 12. In the preferred embodiment, a velocity determining program 62 located in the central computer 60 is able to calculate the relative velocity of the monitoring motor vehicle 12 based on the distance traveled by the monitoring electronic device 20 in a known time period. In other embodiments, the velocity determining program 62 may be located in the monitoring electronic device 20. In still other embodiments, the monitoring electronic device 20 may be directly coupled to the monitoring motor vehicle's speedometer or to the manufacturer's on-board computer so that the current velocity of the monitoring motor vehicle 12 may be instantaneously and continuously transmitted as part of the current movement information 27.

Each monitoring electronic device 20 is also coupled to a wireless communication means which transmits the current movement information 27 and other useful information over a wireless communication system 40 to the central computer 60 connected to a wide area network 45. The central computer 60 collects the uploaded information from monitoring electronic devices 20 located in a plurality of monitoring motor vehicles 12 in the region to create a current traffic congestion database 64, shown more clearly in FIG. 3, that contains traffic congestion information for specific roadways 14–17 in a region.

Each monitoring electronic device 20 is designed to continuously, or intermittently, upload the current movement information 27 to the central computer 60 so that the traffic congestion database 64 is constantly updated. Raw and processed information within the traffic congestion database 64 may be downloaded by authorized users and presented in both visual and audio formats.

In the preferred embodiment, the physical location detecting means is a global positioning system (GPS) receiver 30. The GPS receiver 30 is able to immediately establish the monitoring electronic device's global position, (i.e. latitude, longitude, elevation), heading, and velocity.

The GPS is a location system based on a constellation of twenty-four satellites orbiting, the Earth at altitudes of approximately 11,000 miles. The GPS satellites provide accurate positioning information twenty-four hours per day, anywhere in the world. The GPS uses a receiver that stores orbit information for all GPS satellites. During use, the receiver determines the time and the positions of the overhead satellites and then calculates the amount of time it takes a GPS radio signal to travel from the satellites to the receiver. By measuring the amount of time it takes for a radio signal to travel from the satellites, the exact location of the GPS receiver can be determined. GPS receivers 30 are available from Corvallis Microtechnology, Inc., in Corvallis, Oreg. It should be understood however, that other means for automatically determining the user's physical location could be used.

In the preferred embodiment, the system 10 uses GPS receivers 30 that are 3-ID coordinate receivers that require a minimum of four visible satellites. It should be understood, however, that the system 10 could be used with 2-D coordinate receivers, which require a minimum of three satellites. The 3-D coordinate receivers are preferred, since they will continue to provide 2-D coordinate information when their views are obstructed by trees, mountains, buildings, etc.

When the GPS receiver 30 is turned on, it immediately provides a "fix" position. As it continues to operate, it records "waypoints" at pre-determined intervals (i.e. 1–5 seconds). A client-side software program 28, discussed further below, is designed to receive the "fix" and "waypoints" coordinates and transmit them to the central computer 60 as part of the movement information 27.

Loaded into the memory of each monitoring device 20 and non-monitoring electronic device 22, is a client-side software program 28 that is able to communicate with the server software program 54 located in the central computer 60. When used in the monitoring electronic device 20, the client-side software program 28 collects the movement information 27 and uploads it to the central computer 60. When the user initially logs into the system 10, the client-side software program 28 also transmits the user identification information such as the user's name and password.

As discussed above, the central computer 60 is connected to the wide area network 45 and is able to communicate with a plurality of monitoring electronic devices 20 also connected to the wide area network 45. It should be understood that the central computer 60 may be one server or a group of servers all connected to the wide area network 45. Loaded into the memory of the central computer 60 or in the memory of each server is the server-side software program 56 capable of uploading and processing data from the client side software program 28 used with each monitoring electronic device 20 and non-monitoring electronic device 22. Attached to the central computer 60 is a user information database 63 containing all of the user information and access information for logging onto the system 10.

Figure 3:
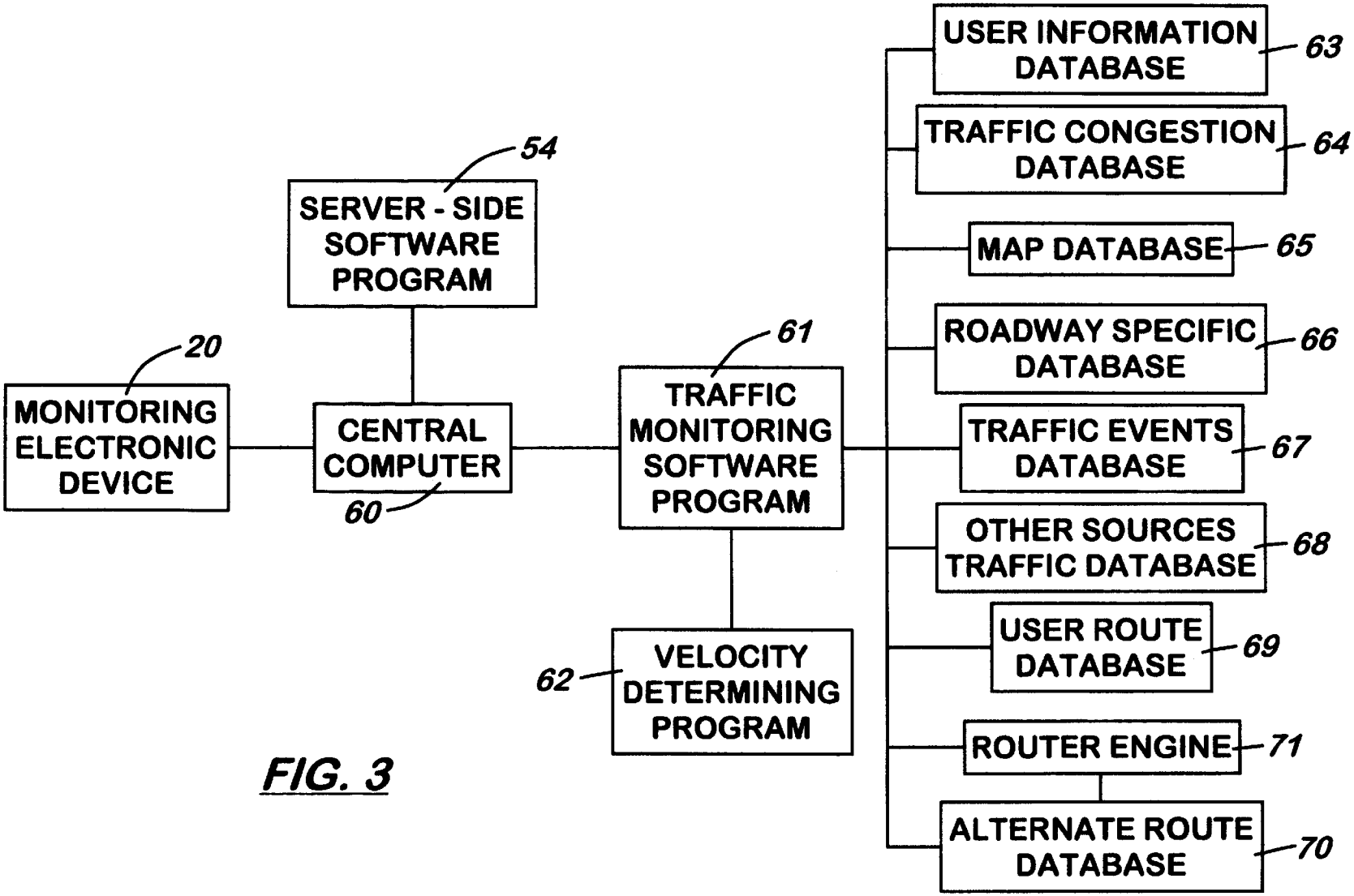
FIG. 3 is a schematic of the traffic monitoring system showing a monitoring electronic device communicating with the central computer, the server-side software program connected to the central computer, the traffic monitoring software program connected to the central computer, and a plurality of databases connected to the central computer.

As shown in FIG. 3, the central computer 60 is connected to a plurality of databases 63–70. The traffic congestion database 64 is created by the traffic congestion software program connected to the central computer 60. The other databases include a roadway-specific database 66, a map database 65, a user route database 69, a traffic event database 67, and an alternative route database 70. Disposed between the alternative route database 70 and the central computer 60 is a router engine 71.

The traffic congestion database 64 stores and updates the current movement information 27 submitted by the monitoring electronic devices 20 in the region. The roadway-specific database 66 contains useful roadway information not normally found on maps, such as the speed limits, the numbers of stop lights, the numbers and types of lanes of traffic. The traffic events database 67 contains important dates and times of events that may impact traffic on roadways in the region. The user route database 69 and the routing engine 71 are used to provide ETA's for current routes taken by users. The alternative route database 70 and the routing engine 71 are used to provide ETA's for alternate routes.

After determining the user is authorized, the central computer 60 begins to receive the current movement information 27 from the monitoring electronic device 20. If the system 10 uses the velocity determines program 62 located in the central computer 60, the velocity of the monitoring vehicle 12 must first be determined. Once the velocity is determined, the complete movement information 27 is then processed by the traffic monitoring software program 61 and compiled with the other data in the traffic congestion database 64. The traffic and map databases 64, 65 respectively, are used to track and monitor current traffic congestion of roadways throughout the entire region. In addition to the traffic congestion database 64 and map database 65, the central computer 60 also reviews data in the roadway-specific database 66 to determine the specific roadway information on the road in which the user is traveling.

In addition to creating a user route database 69, the user of the central computer 60 may create an alternative route database 70. Typically, the user submits a current route taken regularly and then submits one or more alternative routes in the event the current route is heavily congested. The alternative route database 70 stores this information for later use.

When using the system 10 to receive current traffic information, the user may request traffic congestion information either on a current roadway or on an alternative roadway. In both situations, the user's precise location on the current roadway and alternative roadway must be transmitted to the central computer 60. Using the current traffic congestion database 64 and the alternative route database 70, comparative traffic information may be produced and presented to the user enabling the user to choose the less congested route.

The system 10 is designed to use traffic information from other sources. As shown in FIG. 3, an outside source traffic database 68 is created which is used to store traffic data from other sources, such as state and local authorities. Such information may be used in combination with the traffic congestion database 64 to provide constantly updated traffic information to the users.

Figure 4:
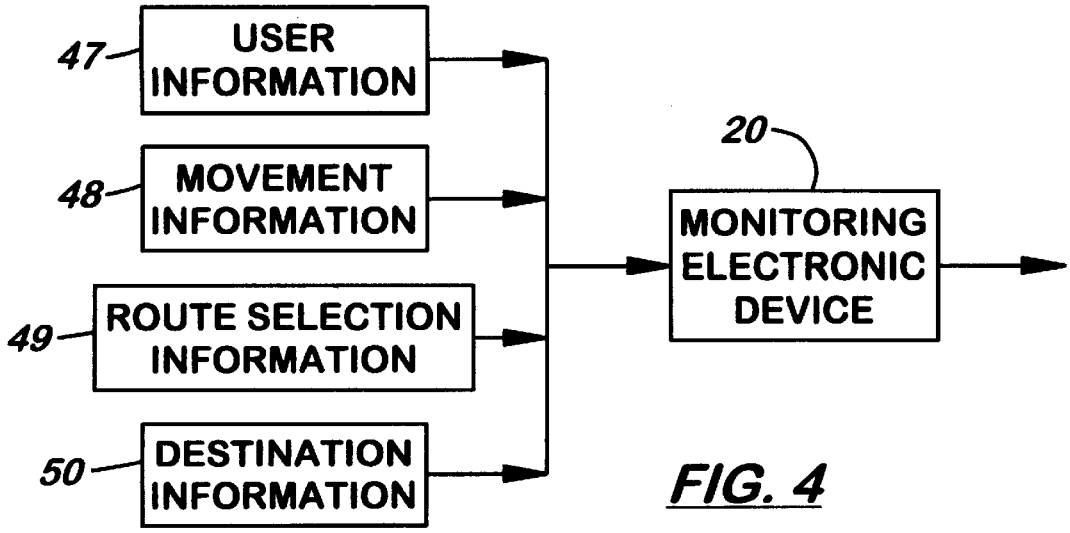
FIG. 4 is a schematic of the traffic monitoring system showing the information collected and transmitted by the monitoring electronic device.

As shown in FIG. 4, the user submits several types of information to the central computer 60. First the user information 47 is submitted to inform the central computer 60 the user is an authorized user. Next, the current movement information 27 described above must be submitted. Next, the route selection information 49 must be submitted informing the central computer 60 which route the user is traveling. During use, the user submits different route information to the central computer 60, which is stored in the user route database 69. Using the map database 65, the various roadways used on a given route may be predefined by the central computer 60. Alternatively, the user may submit his or her own definition of the routes.

Figure 5:
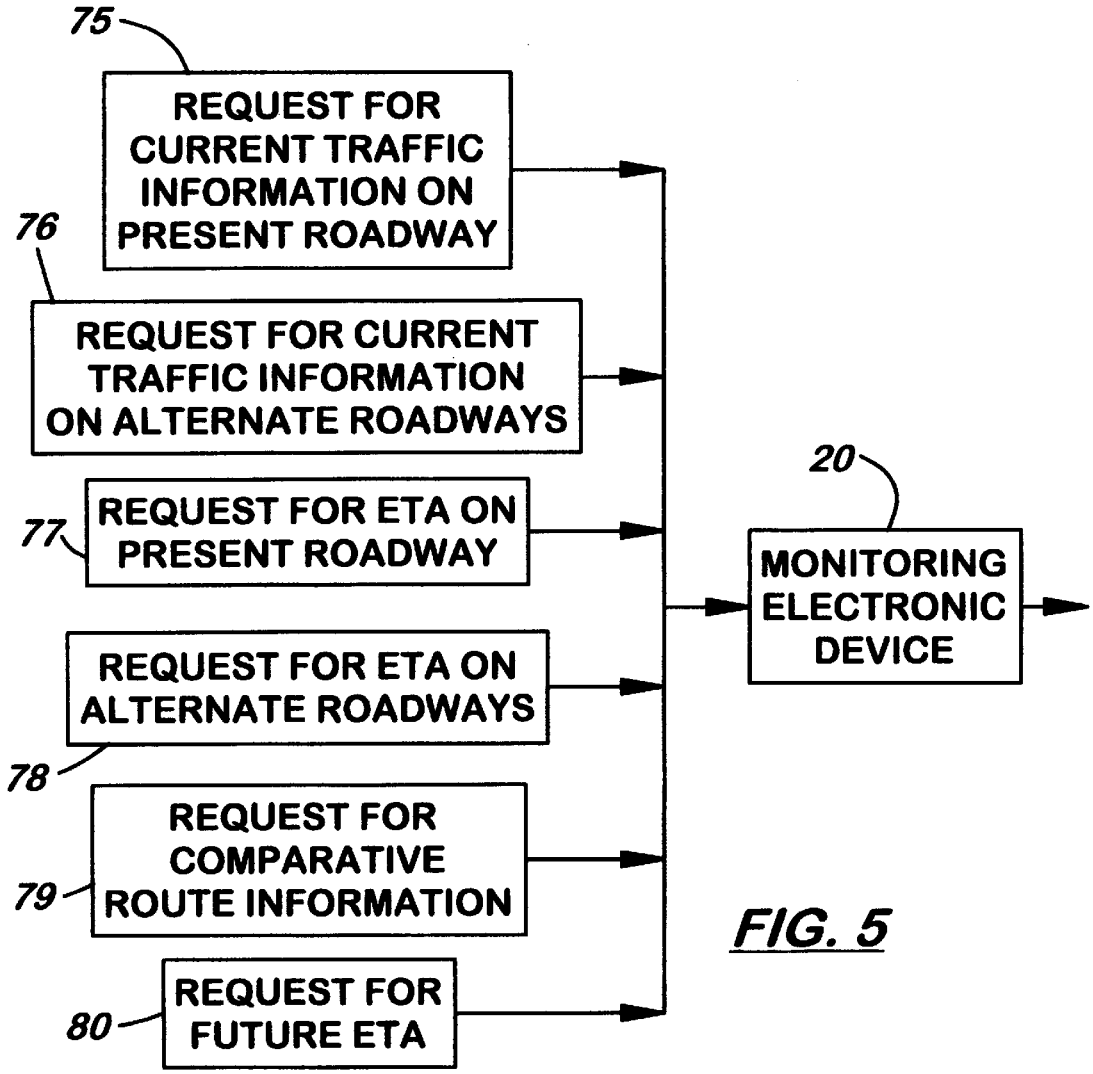
FIG. 5 is a schematic of the traffic monitoring system showing different types of requests submitted by the user to the monitoring electronic device.

In order to receive traffic information from the central computer 60, users must also submit requests. As shown in FIG. 5, these requests include: a request for current traffic information on a present roadway 75, a request for current traffic information on alternative roadways 76, a request for ETA information on a present roadway 77, a request for ETA information on alternative roadways 78, a request for comparative route information 79, and a request for future ETA information of an anticipated route 80. The user may manually submit one or more of the requests 75–80, or set up the client-side software program 28 to default and automatically submit one or more of the requests 75–80 when logged onto the system 10.

Because the GPS receiver 30 is able to provide precise location information, (i.e. within 1 meter), the system 10 is able to provide traffic congestion information on specific lanes of a roadway. The user may request specific lane traffic information 83 when using the system 10, depicted in FIG. 6.

FIG. 2 shows one monitoring motor vehicle 12 with a monitoring electronic device 20 located therein, and a non-monitoring motor vehicle 13 with a non-monitoring electronic device 22 located therein. Shown is a fixed location 18 with a second non-monitoring electronic device 22' located therein. The monitoring electronic device 20 and the first non-monitoring electronic device 22 are coupled to a wireless modem 24, 24', respectively, each capable of connecting to the wireless communication network 40. The wireless communication network 40 is connected to the wide area network 45 via a landline communication link, generally referred to as 42. The second non-monitoring electronic device 22' located in the fixed location 18 is connected to a standard communication link connection 43, which may include an analog modem connected to a standard landline communication link 43, or a digital modem connected to a digital subscription line (DSL) that connects to the wide area network 45.

In order to use the system 10, the user's or electronic device's network address must be known to the central computer 60 so that information may be downloaded thereto. If the central computer 60 is also the authorized user's network service provider to the wide area network 45 and a previously established account has been set up on the central computer 60, the numerical or temporary address would be known to the central computer 60 when the user signs onto the central computer 60. If the user does not have a previously established account on the central computer 60, then the client side software program 28 must be used to collect and transfer the account information to the central computer 60 each time the user logs onto the central computer 60.

During use, the user's personal information is entered into the client side software program 28. When initial contact is made with the central computer 60, the personal information is automatically downloaded to the central computer 60. The client side software program 28 may be a proprietary software program, or may be included as an add-on to an existing INTERNET browser software program. After the account information has been confirmed or set up on the central computer 60, the users may begin to download and/or upload information from the central computer 60.

The following examples illustrate how the system may be used:

Traffic Monitoring and Reporting

The system 10 is designed to provide authorized users continuously updated traffic congestion information for roadways in a region. By determining the current and changing locations of the monitoring electronic devices 20 in motor vehicles traveling on the roadways, a dynamic map of the traffic congestion on the roadways is created.

Figure 6:
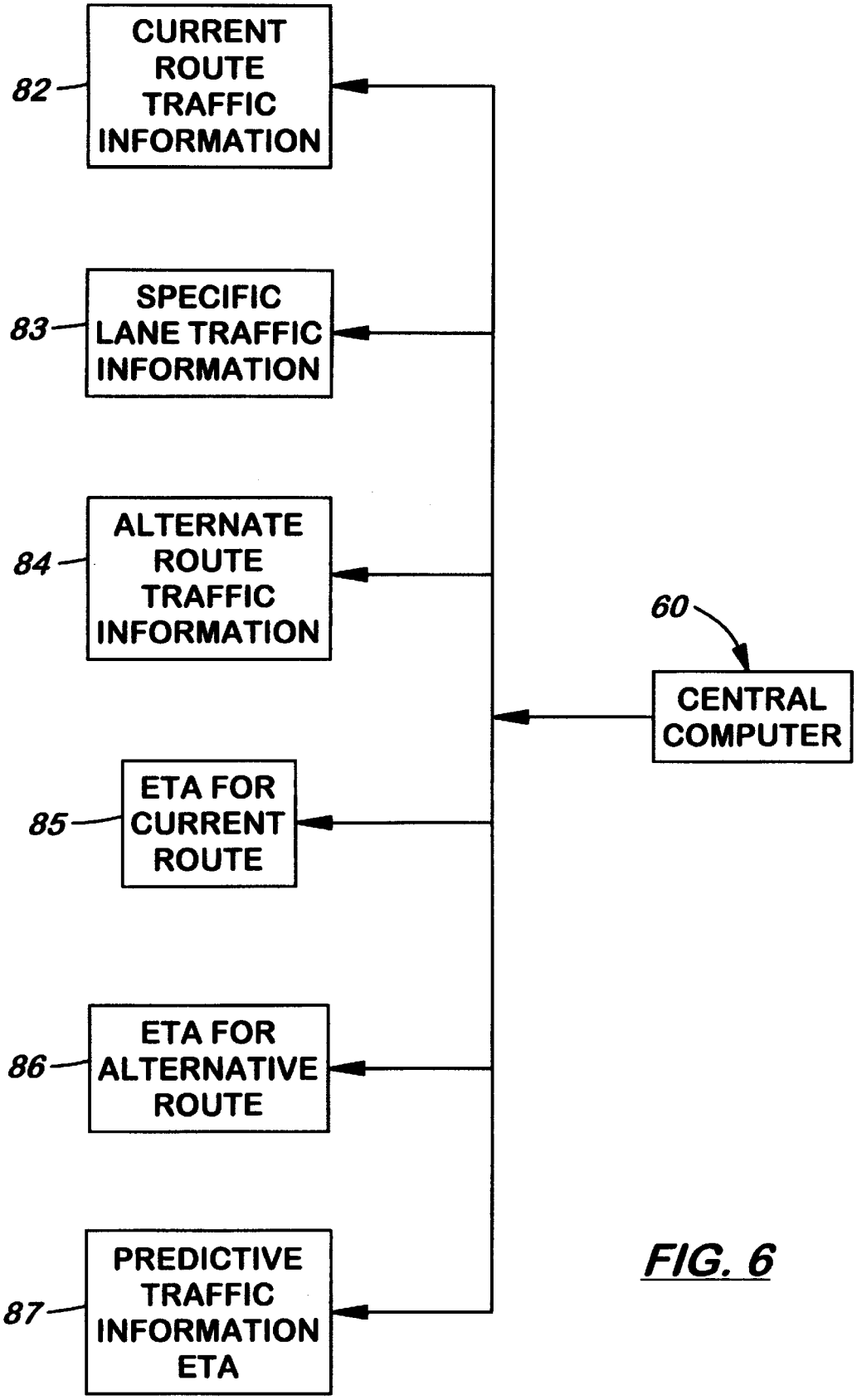
FIG. 6 is a schematic showing the different types of information transmitted by the central computer.

An authorized user uses his or her electronic device (20, shown) to automatically or selectively submit a request for current traffic information 75. At the same time, user information 47 is submitted to the central computer 60. The central computer 60 processes the request 75 by first verifying the user's account information in the user information database 63. If the electronic device is also a monitoring electronic device 20, as shown, movement information 48 is automatically transmitted to the central computer 60 and used to update the traffic congestion database 64. As shown in FIG. 6, the desired current traffic congestion information 82 is then downloaded from the central computer 60 to the monitoring electronic device 20. The downloaded traffic congestion information 82 from the central computer 60 may be displayed on a graphic interface or audibly through speakers. Also, the traffic congestion congestion information 82 may be automatically delivered at designated time intervals, or upon request. The request may also be made manually using the electronic device's keyboard by using a touch screen with a map of the roadway displayed thereon, or with speech recognition software. The important aspect of the system 10 is that the traffic information 82 is constantly being updated by users of the system 10.

Estimated Times of Arrival

In addition to providing current traffic congestion information to authorized users, the system 10 is also designed to provide estimated times of arrival based on current or anticipated traffic conditions. Such use typically begins by an authorized users first transmitting to the central computer 60 a request 77 for an ETA on the present roadway. The request 77 must include the user destination information 50, as shown in FIG. 4. In addition, the route selection information 49 must be submitted. Once the request 77 is submitted to the central computer 60, the central computer 60 first verifies the user's account information, then uses the user route database 69 to identify the specific roadways to be taken on the route. Next, the current traffic congestion information 82 is retrieved from the traffic congestion database 64 and delivered to the router engine 71. The alternative route database 70 may be used to provide ETAs on alternative routes.

If the device is a non-monitoring electronic device 22, which lacks a location device, the user must provide the current location information to the central computer 60. As discussed further below, the central computer 60 may also review the traffic event database 67 shown in FIG. 3, which takes into account outside events that may affect traffic congestion.

It is important to also note that the traffic monitoring software program 61 uses several databases to provide accurate ETAs. For example, the roadway specific database 66 may be used to consider other factors that may affect the ETA, such as the number of stop lights, the number of exits and entrances to a particular roadway, etc.

Alternative Route Recommendations

The system 10 may also be used to recommend alternative roadways to users along a particular route so that they may avoid congestion. First, the user submits a request for comparative route information 79 from the central computer 60. The central computer 60 then processes the request 79 by first verifying the user information 47 with the user database 63. Next, the alternate route database 70 is used to determine the different alternative routes that can be taken from the user's starting location to the designated destination. Next, the traffic events database 67, and roadway specific database 66 is used. The router engine 71 is then used to calculate the ETAs of the current and alternative routes.

Predictive Traffic Congestion

The system 10 may be used to provide anticipated traffic congestion information to an authorized user. First, the user uses the electronic device 20 to transmit his or her account information, a request for future traffic congestion ETA information 80, the desired route selection information 49, and the day and start time for the trip. The central computer 60 then verifies the user's account information with the user database 63 and then uses the traffic congestion database 64 which contains old records of traffic congestion information for the identical day and time map. Next, the roadway specific database 66 and the traffic event database 67 are reviewed. The central computer 60 can then use the router engine 71 to provide an ETA information 85 for the anticipated trip. As an optional feature, the central computer 60 can use the alternate roadway database 70 and provide ETA information 86 for alternative routes.

In compliance with the statute, the invention, described herein, has been described in language more or less specific as to structural features. It should be understood, however, the invention is not limited to the specific features shown, since the means and construction shown comprise only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A traffic monitoring system for a selected region, comprising:

a. a plurality of monitoring electronic devices, each said monitoring electronic device being located in a motor vehicle traveling in a selected region;

b. a physical location detecting means coupled to each said monitoring electronic device, said physical location detecting means being used to determine the physical location of each said monitoring electronic device;

c. a velocity determining means for determining the velocity of a motor vehicle containing each said monitoring electronic device;

d. a wireless communication means connected to said monitoring electronic device enabling each said monitoring electronic device to connect to a wireless communication network;

e. a wireless communication network located around a region;

f. a wide area network;

g. a central computer connected to said wide area network, said central computer being to used receive said physical location and velocity information from a plurality of said monitoring electronic devices located in motor vehicles in a region and connected to said wide area network by said wireless communication means;

h. a map database connected to said central computer, and;

i. a traffic monitoring software program connected to said central computer, said traffic monitoring software program being used to collect said physical location and velocity information and said map database to create a traffic congestion database for the region, a portion of said traffic congestion database being transmitted over said wide area network and said wireless communication means to each said monitoring electronic devices.

2. The traffic monitoring system, as recited in claim 1, further including a roadway specific database, said roadway specific database including specific information of selected roadways in a region, said specific information including the speed limit and the number and types of lanes on a roadway.

3. The traffic monitoring system, as recited in claim 1, further including a user route database connected to said central computer, said user route database containing specific route information which may be selected by the user to request traffic congestion information on specific routes.

4. The traffic monitoring system, as recited in claim 1, further including means to provide comparative traffic congestion data for alternative routes.

5. The traffic monitoring system, as recited in claim 1, further including means to calculate the estimated times of arrival for a selected route.

6. The traffic monitoring system, as recited in claim 1, further including a traffic events database connected to said central computer, said traffic events database containing event information that affects traffic on selected roadways in a region.

7. The traffic monitoring system, as recited in claim 1, further including an other sources traffic database containing traffic congestion information from outside sources.

8. The traffic monitoring system, as recited in claim 1, further including means on each said monitoring device to manually input traffic data to said central computer.

9. The traffic monitoring system, as recited in claim 1, wherein said traffic congestion information is continuously sent to each said monitoring electronic device.

10. The traffic monitoring system, as recited in claim 1 wherein said physical location detecting means is a GPS receiver used in a GPS network.

11. The traffic monitoring system, as recited in claim 1, wherein said wireless communication means is a wireless modem for communicating with said wireless communication network.

12. The traffic monitoring system, as recited in claim 1, further including a client-side software program loaded into each said monitoring electronic device and a server side software program loaded into said central computer to enable said monitoring electronic device to communicate with said central computer.

13. The traffic monitoring system, as recited in claim 1, wherein said traffic congestion information transmitted to said monitoring electronic devices includes flow information of a specific lane of traffic on a selected roadway.

14. The traffic monitoring system, as recited in claim 1, further including a plurality of non-monitoring electronic devices, each said non-monitoring electronic device including a wireless communication means enabling each said non-monitoring electronic device to connect over said wireless communication network and said wide area network to said central computer to download said traffic congestion information therefrom.

15. The traffic monitoring system, as recited in claim 14, wherein said non-monitoring electronic device is connected to a wireless modem for connecting to a wireless communication network.

16. A traffic monitoring system, comprising:

a. a plurality of monitoring electronic devices, each said monitoring electronic device being located in a motor vehicle traveling in a selected region;

b. a physical location detecting means coupled to each said monitoring electronic device, said physical location detecting means being used to determine the physical location of each said monitoring electronic device;

c. a velocity determining means for determining the velocity of a motor vehicle containing each said monitoring electronic device;

d. a wireless communication means connected to each said monitoring electronic device enabling each said monitoring electronic device to connect to a wireless communication network;

e. a wireless communication network located around a region;

f. a wide area network;

g. a central computer connected to said wide area network, said central computer being used to receive said physical location from a plurality of said monitoring electronic devices located in motor vehicles in a region and connected to said wide area network by said wireless communication means;

h. a map database connected to said central computer, i. a user route database containing selected route information for users of said system;

j. means to calculate the estimated times of arrival for a selected route, and;

k. a traffic monitoring software program connected to said central computer, said traffic monitoring software program being used to collect said physical location and velocity information and said map database to create a traffic congestion database for the region, a portion of said traffic congestion database being transmitted over said wide area network to a plurality of said monitoring electronic devices.

17. The traffic monitoring system, as recited in claim 16, further including means to provide comparative traffic congestion data for alternative routes.

18. The traffic monitoring system, as recited in claim 16, further including a traffic events database connected to said computer, said traffic event database containing event information that affects traffic on selected roadways in a region.

19. The traffic monitoring system, as recited in claim 16, further including an other sources traffic database containing traffic congestion information from outside sources.

20. The traffic monitoring system, as recited in claim 16, further including a means on each said monitoring electronic device to manually input traffic data to said central computer.

21. The traffic monitoring system, as recited in claim 16, wherein said traffic congestion information is continuously sent to at least one said monitoring electronic device.

22. The traffic monitoring system, as recited in claim 16, wherein said physical location detecting means is a GPS receiver used in a GPS network.

23. The traffic monitoring system, as recited in claim 16, wherein said wireless communication means is a wireless modem for communicating with said wireless communication network.

24. The traffic monitoring system, as recited in claim 16, further including a client-side software program loaded into each said monitoring electronic device and a server-side software program loaded into said central computer to enable said monitoring electronic device to communicate with said central computer.

25. The traffic monitoring system, as recited in claim 16, wherein said traffic congestion information transmitted to said monitoring electronic device includes flow information of a specific lane of traffic on a selected roadway.

26. A traffic monitoring system, comprising;

a. a wireless communication network;

b. a wide area network connected to said wireless communication means;

c. a central computer connected to said wide area network;

d. a plurality of electronic devices each having means to connect to said central computer over said wireless communication network and said wide area network, each said electronic device being located in a motor vehicle traveling on a roadway in a selected region;

e. a means to collect and transmit movement information of each said electronic device to said central computer;

f. a map database connected to said central computer, g. a traffic monitoring software program connected to said central computer, said traffic monitoring software program being used to collect said movement information from a plurality of motor vehicles and incorporating said movement information with said map database to create a traffic congestion database for a region, a portion of said traffic congestion database being selectively transmitted over said wide area network to said electronic devices connected thereto.

27. The traffic monitoring system as recited in claim 26, wherein said central computer is using said traffic monitoring software program to constantly collect, process, and transmit traffic congestion information.

28. The traffic monitoring system, as recited in claim 27, further including a user route database containing selected route information.

29. The traffic monitoring system, as recited in claim 28, further including means to recommend alternative routes from said user route database.

* * * * *